US007372192B2

(12) United States Patent
Ricaud et al.

(10) Patent No.: US 7,372,192 B2
(45) Date of Patent: May 13, 2008

(54) CATHODE FOR CATHODE RAY TUBE WITH IMPROVED LIFETIME

(75) Inventors: Jean-Luc Ricaud, Dijon (FR); Jean-Michel Roquais, Dijon (FR)

(73) Assignee: Thomson Licensing, Boulogne Billancourt (FR)

( * ) Notice: Subject to any disclaimer, the term of this patent is extended or adjusted under 35 U.S.C. 154(b) by 254 days.

(21) Appl. No.: 10/498,045

(22) PCT Filed: Nov. 29, 2002

(86) PCT No.: PCT/EP02/13465

§ 371 (c)(1),
(2), (4) Date: Jun. 8, 2004

(87) PCT Pub. No.: WO03/050837

PCT Pub. Date: Jun. 19, 2003

(65) Prior Publication Data

US 2005/0140262 A1 Jun. 30, 2005

(30) Foreign Application Priority Data

Dec. 10, 2001 (FR) ..... 01 15929

(51) Int. Cl.
*H01T 13/20* (2006.01)

(52) U.S. Cl. ..... 313/143; 313/346 R; 313/346 DC

(58) Field of Classification Search ..... 313/346 R, 313/143, 346 DC, 270, 446
See application file for complete search history.

(56) References Cited

U.S. PATENT DOCUMENTS 4,101,800 A 7/1978 Thomas et al.
4,494,035 A * 1/1985 Palluel et al. ..... 313/346 R
4,837,480 A * 6/1989 Breeze et al. ..... 313/346 DC
6,016,026 A * 1/2000 Lee ..... 313/346 R
6,252,341 B1 * 6/2001 Hasegawa et al. ..... 313/346 R

FOREIGN PATENT DOCUMENTS

JP 57-115739 7/1982

OTHER PUBLICATIONS

Patent Abstracts of Japan, vol. 006, No. 211, Oct. 23, 1982 & JP 57-115739 (See Reference AD).
Search Report Dated Feb. 6, 2003.

* cited by examiner

*Primary Examiner*—Joseph L. Williams
*Assistant Examiner*—Hana A Sanei
(74) *Attorney, Agent, or Firm*—Joseph J. Laks; Harvey D. Fried; Richard LaPeruta

(57) ABSTRACT

Impregnated cathode for a vacuum tube comprising an emissive part in the form of a porous pellet impregnated with a compound of alkaline earth metals; the pellet is placed in a dish made of a refractory material and covered with a porous metal foil forming the emissive surface of the cathode. Moreover, the pellet has a separation surface between a heavily impregnated zone and a zone which is not impregnated or weakly impregnated so that the said separation surface comprises at least a hollow part facing the emissive surface. By virtue of the shape of this separation surface, the lifetime of the cathode is improved.

9 Claims, 2 Drawing Sheets

CATHODE FOR CATHODE RAY TUBE WITH IMPROVED LIFETIME

Figure 1:
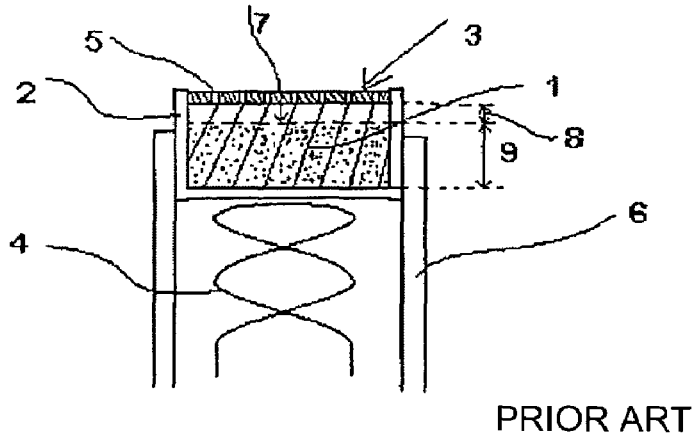

This application claims the benefit, under 35 U.S.C. § 365 of International Application PCT/EP02/23465, filed Nov. 29, 2002, which was published in accordance with PCT Article 21(2) on Jun. 19, 2003 in English and which claims the benefit of French patent application No. 0115929, filed Dec. 10, 2001.

The subject of the present invention is an impregnated cathode for cathode-ray tubes and more particularly an impregnated cathode with an improved lifetime.

An impregnated cathode consists of a porous metal body, otherwise called a pellet, which is impregnated by a material called the impregnating agent capable of emitting electrons, this material being predominantly composed of a metal oxide, for example barium oxide. The porous metal body is generally made of a refractory metal such as, for example, tungsten or molybdenum. The porous metal body is placed inside a metal dish, itself made of a refractory material. A porous metal foil obtained either by perforation of a solid foil, or by pressing, sintering and possible impregnation, is placed above the pellet. The impregnating material reacts chemically with the pellet and produces the emissive material, for example one based on barium or barium oxide, which emissive material will migrate in the pellet and pass through the pores of the metal foil in order to coat its surface, the said surface then forming the emissive surface of the cathode.

In the field of cathode-ray tubes, the current trend is towards a great increase in the direction of a high increase in the cathode current density in order to use these tubes in high-definition applications, for example in the field of television. Now, it has been noted that the lifetime of the cathode depended considerably on the current density that was required of it.

Various methods have been proposed to increase the lifetime of impregnated cathodes, such as for example:

- slower evaporation of the emissive material such as barium, either by reducing the porosity of the impregnated pellet, or by lowering the operating temperature,
- increasing the reservoir of impregnating material and therefore of emissive material, either by increasing the volume of the pellet, or by adding a reservoir under the pellet.

However, although these solutions make it possible to increase the lifetime of the cathode at low current density, this lifetime is not substantially altered at high current density for the following reasons:

- if the porosity is reduced, this leads to a reduction in the size of the reservoir of impregnating material
- if the operating temperature is reduced, the electron emission decreases
- the flow of emissive material decreases with the distance which separates it from the emissive surface, since along the way the emissive material evaporates in proportion to its surface area exposed to the vacuum
- adding a reservoir under the pellet is a particularly expensive solution which cannot be used for manufacturing mass-market products and which makes activation of the cathode longer.

The subject of the invention is a particular cathode structure making it possible to act not on the size of the reservoir of emissive material, but on the flow of emissive material, and more particularly on the rate at which the reservoir is emptied.

For this, an impregnated cathode according to the invention comprises a porous emissive pellet impregnated by an alkaline earth metal compound, the said pellet being placed in a dish made of a refractory material and covered with a porous metal foil forming the emissive surface of the cathode, characterized in that the pellet has a separation surface between a heavily impregnated zone and a zone which is not impregnated or weakly impregnated, the said separation surface comprising at least one hollow part facing the emissive surface.

Figure 2:
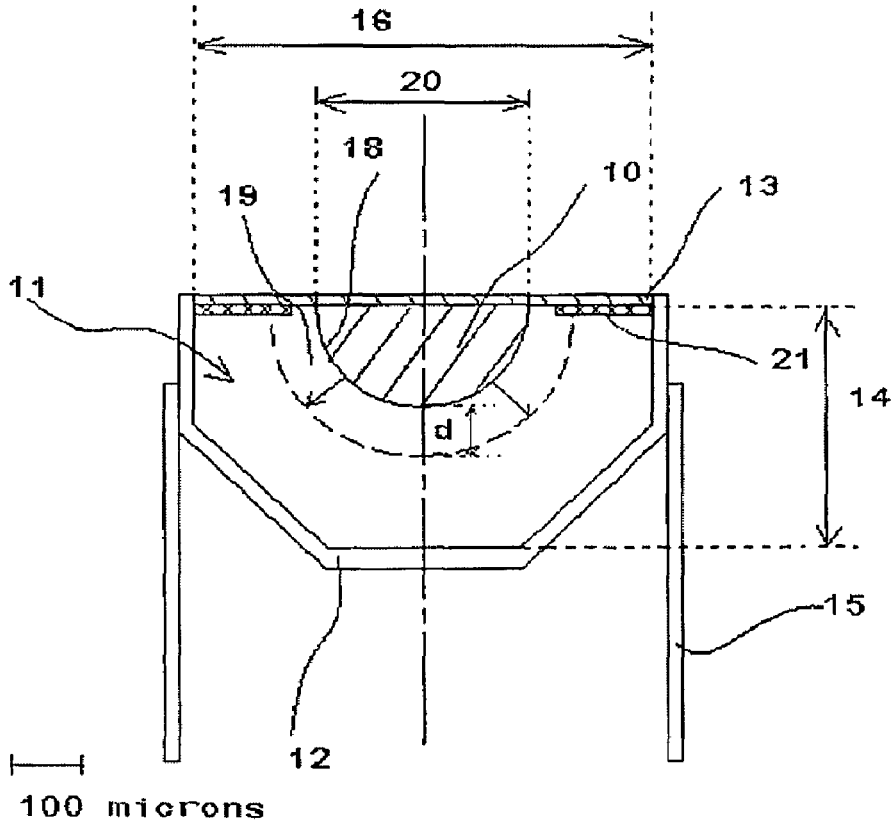
Figure 3:
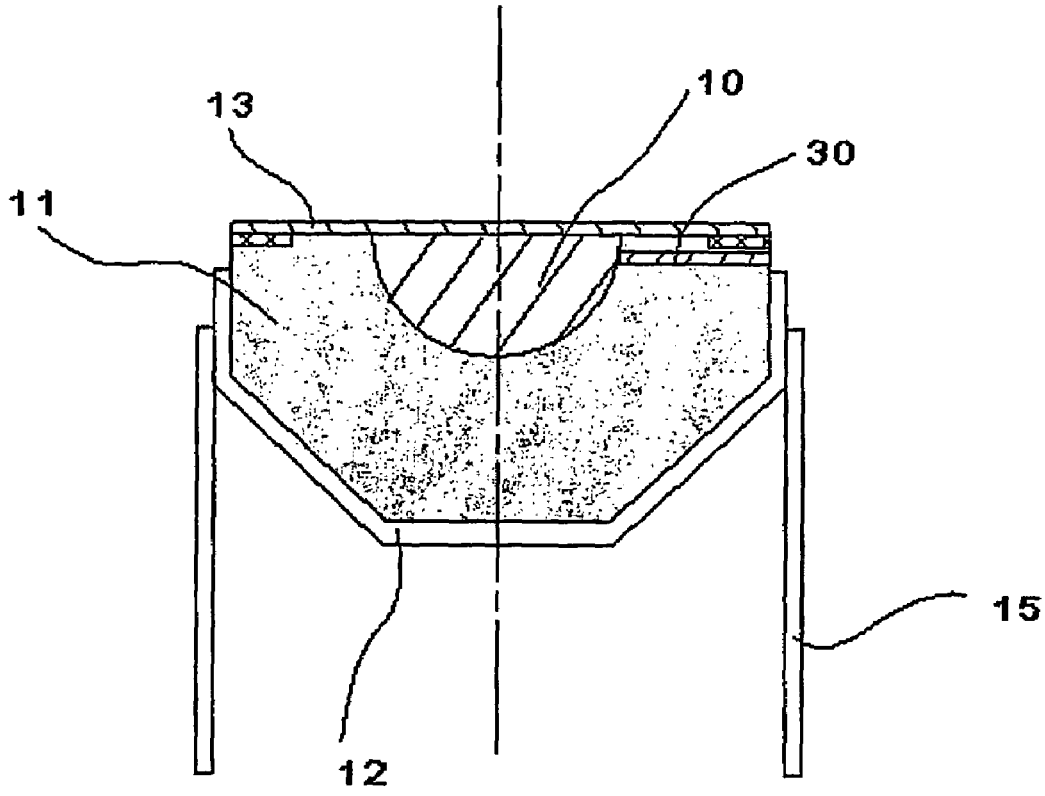

The invention and its advantages will be better understood using the description below and the drawings among which:

FIG. 1 illustrates an embodiment of an impregnated cathode according to the prior art FIG. 2 shows a first embodiment of the invention FIG. 3 illustrates a variant embodiment of a cathode according to the invention.

An impregnated cathode according to the prior art is described, for example, in U.S. Pat. No. 4,101,800. A cathode of this sort, illustrated by FIG. 1, comprises a homogeneously impregnated porous pellet 1 made of emissive materials such as, for example, compounds of alkaline earth metals such as barium or calcium; the pellet is inserted into a dish 2 made of a refractory material such as molybdenum or tantalum. The pellet is covered with a porous metal foil 3 attached to the dish by laser welding or brazing. The metal foil 3 is, for example, made by pressing and sintering a metal such as tungsten. The dish 2 is secured to a hollow cylindrical sleeve 6 inside which the heating filament 4 of the cathode is placed.

During cathode operation, emissive materials such as barium and barium oxide are generated in the pores of the pellet and will migrate towards the emissive surface and pass through the foil 3 via its orifices 5. The evaporated barium, diffused by the pellet, continues its path through the foil 3, part of which is deposited thereon and another part of which passes through in vapour form. The lower the porosity of the foil, the greater is the part of barium which is deposited thereon. The deposited barium spreads very quickly and becomes uniform over the surface because of the high temperature of the foil, a temperature which is almost identical to the operating temperature of the pellet. The barium spread over the upper surface of the perforated foil makes the latter act as an electron-emissive surface.

The barium flow is caused by a chemical reaction between the impregnating agent and the material, such as tungsten, constituting the pellet and this flow is directed towards the free path formed by the emissive surface 3. Thus a depletion front 7 is formed, the surface of which is substantially parallel to the emissive surface of the pellet. The depletion front defines a boundary between a zone 8 which is very depleted in emissive material and which is located directly under the foil 3 and a deeper zone 9 in which the density of the emissive material has not yet been altered. The depletion front will move while having a surface substantially parallel to the emissive surface during the life of the cathode, the depth at which the barium is located below the emissive surface increasing progressively with the operating life of the cathode.

The invention is based on the fact that it has been noticed that during operation, the depletion front moves while having a surface substantially parallel to its initial surface, like a slow combustion front. Moreover, the flow of emissive material such as barium decreases with the distance separating it from the emissive surface. The result of this is that the barium located far from the emissive surface cannot be useful. As described by A. M. Shroff in "Applications of Surface Science 8", pages 3649, published by North Holland Publishing Company in 1981, the flow of emissive material decreases as the depletion front gradually moves away from the emissive surface according to a law whereby the flow is inversely proportional to the square root of the time during which the cathode has been used.

Two phenomena cause this decrease in flow of emissive material:

- diffusion of the barium oxide towards the surface to be reduced to barium is increasingly difficult as the residues of chemical reactions gradually accumulate in the pores.
- as the depletion front gradually moves away from the emissive surface, the emissive material evaporates in proportion to its surface area exposed to the vacuum which is increased in proportion to the separation.
- as the depletion front gradually moves away from the emissive surface, the emissive material has to diffuse along a greater distance and, on its path, tends to cover a metal surface which increases with this distance which moreover decreases the amount of material which reaches the surface.

The invention provides a solution to these problems without altering the chemical phenomena occurring in the pellet, or its porosity, or its operating temperature.

As illustrated in FIG. 2, the invention separates the function of the emissive material source and the function of the emissive surface so as to geometrically amplify the flow of emissive material therebetween.

For this, the cathode consists of an emissive pellet 11 inserted in a dish 12. The pellet is covered with a porous metal foil 13, for example made by pressing and sintering tungsten powder, a metal foil which may advantageously be impregnated with impregnating material.

During its manufacture, the pellet 11 has the particular feature of having a heavily impregnated zone 19 and a zone 10 which is weakly impregnated or not impregnated at all. The separation surface 18 between these two zones has the geometrical characteristic of being concave and of having at least one hollow between the foil 13 forming the emissive surface of the cathode and the heavily impregnated part 19 of the pellet.

In the embodiment illustrated in FIG. 2, the separation surface 18 has a hemispherical concavity arranged in the centre of the pellet. The pellet 11 has a porosity preferably between 15% and 35%, and a diameter 16 of 1.3 mm. Its depth 14 is 0.6 mm and the cavity 10 located at its centre has a diameter 20 of 0.7 mm. A metal foil 13 is placed over the pellet, which foil may or may not be impregnated, with a porosity between 15% and 35% and having a thickness of 20 μm to 50 μm; the foil is preferably coated with a layer of alloy such as, for example, osmium/ruthenium or with iridium which lowers the work function of the electrons. The pellet is inserted into a dish 12 which is secured to a cylindrical sleeve, for example by laser welding.

The foil 13 and the pellet are secured one to the other by a brazed joint 21 with a high-melting-point metal base such as molybdenum and ruthenium connecting their peripheral surface and surrounding the zone 10. The molybdenum/ruthenium based mixture can be prepared from powders mixed with a solvent, then applied in layers of a few μm in thickness, and finally melted using the laser while pressing the foil and the previously impregnated pellet one against the other.

In this way, the depletion front will initially be formed at the hemispherical surface 18, the brazed joint 21 forming a barrier impermeable to the emissive material coming from the pellet. The depletion front will then move while remaining parallel to a hemispherical surface and its surface will increase as the front is gradually forced into the pellet according to a law of the type:

$$d(t)=A\cdot t^{1/2}$$

where d is the distance of the front from its initial position, A is a coefficient which depends on the porosity of the pellet and on the operating temperature, and t is the time.

The surface area of the front will then increase according to a law of the type:

$$S(t)=K(R+d(t))^2=K(R+A\cdot t^{1/2})^2$$

where R is the initial radius of the surface 18, and K is a constant coefficient defined by the portion of sphere represented by the surface 18.

Thus the dependence of the flow of emissive material on the time of pellet use is modified: the increase in the surface area of the depletion front with the time of cathode use brings an increasingly large zone of the impregnated pellet into service, which involves an increasingly large amount of emissive material; this effect counterbalances the natural effects of decreasing emissive material flow described above such that, in the structure of the invention, the flow of useful emissive material decreases more slowly than in a structure such that of FIG. 1. It will be noted moreover that this advantage increases with time.

The table below shows the variations in the depletion front, in the barium flow and in the cathode emission in the case of the prior art illustrated in FIG. 1 and in the case of the invention.

| Cumulative operating | Depletion (μm) | | Barium flow (relative %) | | Emission (μA) | |
|---|---|---|---|---|---|---|
| time (weeks) | Standard cathode | Invention | Standard cathode | Invention | Standard cathode | Invention |
| 0 | 0 | 0 | 100 | 87 | 6300 | 6300 |
| 5 | 24 | 24 | 45 | 44 | 6300 | 6300 |
| 10 | 33 | 33 | 32 | 33 | 6300 | 6300 |
| 15 | 41 | 41 | 26 | 28 | 6300 | 6300 |
| 20 | 47 | 47 | 22 | 25 | 6300 | 6300 |
| 30 | 58 | 58 | 18 | 22 | 6100 | 6300 |
| 40 | 67 | 67 | 16 | 20 | 5900 | 6300 |
| 50 | 75 | 75 | 14 | 18 | 5700 | 6300 |
| 60 | 82 | 82 | 13 | 17 | 5500 | 6300 |
| 70 | 88 | 88 | 12 | 16 | 5300 | 6300 |
| 80 | 94 | 94 | 11 | 16 | 5100 | 6300 |
| 90 | 100 | 100 | 11 | 15 | 4900 | 6300 |
| 100 | 105 | 105 | 10 | 15 | 4700 | 6100 |
| 110 | 111 | 111 | 10 | 14 | 4500 | 5900 |
| 120 | 115 | 115 | 9 | 14 | 4300 | 5700 |
| 130 | 120 | 120 | 9 | 14 | 4100 | 5500 |
| 140 | 125 | 125 | 8 | 14 | 4000 | 5300 |
| 150 | 129 | 129 | 8 | 13 | 3900 | 5100 |

It can be noted that, by setting the lower limit of the cathode emission to 5100 μA, the lifetime of the cathode went from 80 weeks for the cathode according to the prior art to 150 weeks for a cathode according to the invention.

To produce the initial hemispherical surface 18, it is possible to start with a homogeneously impregnated pellet; after masking part of the upper surface of the pellet, for example a peripheral zone of the said surface, the spatially controlled dissolution of the impregnating agent is carried out so as to create a hemispherical zone with very little impregnating agent or none at all.

It is also possible to produce this separation surface 18 from a pellet 11 on which a hemispherical zone 10 free of any material is created mechanically, for example by pressing, then homogeneously impregnated. In this embodiment the emissive material crosses the cavity 10 in vapour form and does not have to cover the surface of the pores as in the previous embodiment. In this case a problem may be created when the cathode-ray tube equipped with a cathode of this sort is placed under vacuum and particularly when the foil 13 which covers the pellet is porous and impregnated with emissive material; a pressure drop is then created between the air contained in the zone 10 and the progressive vacuum prevailing within the tube, a pressure drop which may lead to breakage of the foil 13. FIG. 3 illustrates an embodiment of the invention providing a solution to this problem; the cavity 10 is set to the external pressure by means of at least one channel 30 made in the impregnated pellet 11 connecting the cavity to the outside of the cathode.

In all cases, in order to obtain an appreciable effect of extending the cathode lifetime, it is desirable that the surface area of the initial separation surface 18 is greater than the emissive surface of the cathode by at least 20%.

The above embodiments are not limiting; it is advantageously possible to provide several concave cavities on the surface of the impregnated pellet or to replace the hemispherical cavity by a surface in the shape of a half torus.

The invention claimed is:

1. Impregnated cathode, the emissive part of which comprises a porous pellet impregnated by an alkaline earth metal compound, the said pellet being placed in a dish made of a refractory material and covered with a porous metal foil forming the emissive surface of the cathode, wherein the pellet has a separation surface between a heavily impregnated zone and a zone which is not impregnated or weakly impregnated, the said separation surface comprising at least one concave part facing the emissive surface.

2. Impregnated cathode according to claim 1, wherein the space located between the concave part and the emissive surface is at least in part, free of any material.

3. Impregnated cathode according to claim 1, wherein the empty space located between the concave part and the emissive surface communicates with the outer space by virtue of at least one channel.

4. Impregnated cathode according to claim 1, wherein the concave part of the separation surface is obtained by selective dissolution of the impregnating agent of the pellet.

5. Impregnated cathode according to claim 1, wherein the concave part is a portion of a spherical surface.

6. Impregnated cathode according to claim 1, wherein the surface area of the concave parts is greater than the emissive surface by at least 20%.

7. Impregnated cathode according to claim 1, wherein the surface of the pellet comprises, around the concave part, a metal barrier sealed against diffusion of the emissive material.

8. Cathode according to claim 1, wherein the metal barrier consists of an alloy of metals having a high melting point.

9. Cathode-ray tube wherein it comprises a cathode according to claim 1.

* * * * *